US007491072B2

(12) United States Patent
Cheng

(10) Patent No.: US 7,491,072 B2
(45) Date of Patent: Feb. 17, 2009

(54) ELECTRICAL CARD CONNECTOR

(75) Inventor: Yung-Chang Cheng, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/824,907

(22) Filed: Jul. 3, 2007

(65) Prior Publication Data

US 2008/0003848 A1 Jan. 3, 2008

(30) Foreign Application Priority Data

Jul. 3, 2006 (TW) ..... 95211651 U

(51) Int. Cl.
*H01R 13/62* (2006.01)

(52) U.S. Cl. ..... 439/159; 439/607

(58) Field of Classification Search ..... 439/159, 439/92, 630, 607, 609
See application file for complete search history.

(56) References Cited

U.S. PATENT DOCUMENTS

| | | | | |
|---|---|---|---|---|
| 6,120,322 | A | 9/2000 | Ho et al. | |
| 7,097,475 | B2 | 8/2006 | Cheng | |
| 7,147,495 | B2 * | 12/2006 | Kuo | 439/159 |
| 7,189,087 | B2 * | 3/2007 | Taguchi | 439/159 |
| 7,189,088 | B2 * | 3/2007 | Cheng et al. | 439/159 |
| 7,232,320 | B2 * | 6/2007 | Kuo | 439/159 |

* cited by examiner

*Primary Examiner*—Khiem Nguyen
(74) *Attorney, Agent, or Firm*—Wei Te Chung

(57) ABSTRACT

An electrical card connector (1), defining a card insertion/ejection direction, includes an insulating housing (2), a plurality of terminals (3) received in the insulating housing, a shell (4) covering the insulating housing and a covering plate (6) spanning over the rear end of the shell. The shell includes a pair of lateral walls (41) to form a card receiving room, and a card inserting opening is formed at a rear end thereof along a card insertion direction. A rear margin of the covering plate reaches a wall of an electrical device in which the electrical card connector is assembled.

12 Claims, 5 Drawing Sheets

ELECTRICAL CARD CONNECTOR

BACKGROUND OF THE INVENTION

1. Field of the Invention

The present invention relates generally to an electrical card connector, and particularly to such an electrical card connector assembled on a printed circuit board.

2. Description of Related Arts

Electrical card connectors are widely used in computer industry for electrically connecting with inserted electrical cards which function as removable mass storage devices. In order to facilitate widespread use of electrical cards, certain standards have been developed, for example, in later of 2003, a new standard, Express Card, is published by PCMCIA (Personal Computer Memory Card International Association). This new Express Card standard has two different types, a rectangular electrical card, and an L-shaped electrical card. Accordingly, two different types of electrical card connectors are provided to accommodate these two express cards. Noticeably, a rectangular electrical card connector can only accommodate a rectangular electrical card, and an L-shaped electrical card connector can accommodate two different types of electrical cards respectively.

An electrical card connector is assembled on a printed circuit board to make sure that the information carried by an inserted electrical card can be transmitted to some electrical devices. Generally speaking, an electrical card connector defines a card inserting opening. However, a cutout that is defined on an electrical device may be spaced a distance away from the card inserting opening of the connector. So, when a card is inserted through the cutout of the electrical device, the card may cock upwardly and be destroyed by an upper shell of the connector. Of course, it can be avoided by increasing the length of the whole electrical card connector, but it needs redesign another die, accordingly, the cost is increased.

Hence, an improved electrical card connector is desired.

SUMMARY OF THE INVENTION

Accordingly, an object of the present invention is to provide an electrical card connector which can effectively direct an electrical card into a card receiving room to avoid damage to the card.

Another object of the present invention is to provide an electrical card connector that can effectively reduce costs caused by launching another die.

To achieve the above objects, an electrical card connector, defining a card insertion/ejection direction, includes an insulating housing, a plurality of terminals received in the insulating housing, a shell covering the insulating housing and a covering plate spanning over the rear end of the shell. The shell includes a pair of lateral walls to form a card receiving room, and a card inserting opening is formed at a rear end thereof along a card insertion direction. A rear margin of the covering plate reaches a wall of an electrical device in which the electrical card connector is assembled.

Other objects, advantages and novel features of the invention will become more apparent from the following detailed description when taken in conjunction with the accompanying drawings.

DETAILED DESCRIPTION OF THE PREFERRED EMBODIMENT

Figure 1:
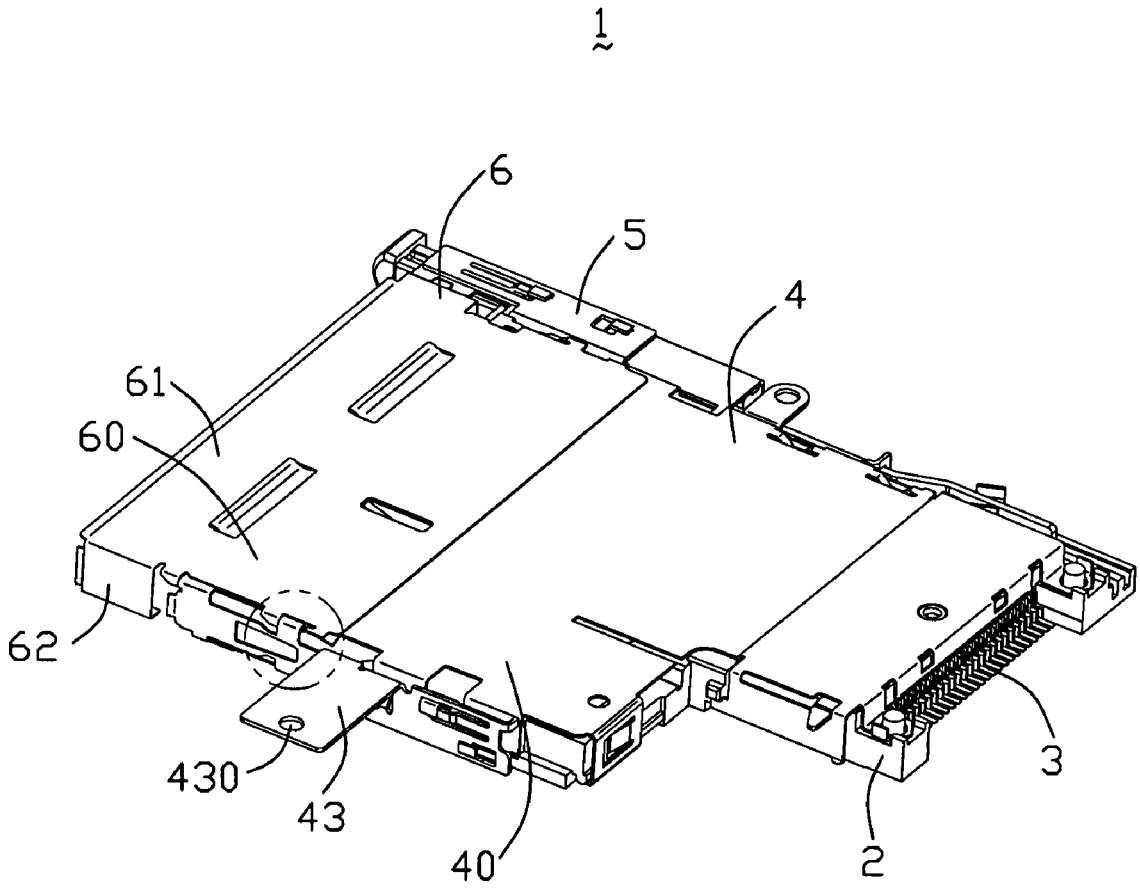
FIG. 1 is an assembled view of an electrical card connector in accordance with the present invention.
Figure 2:
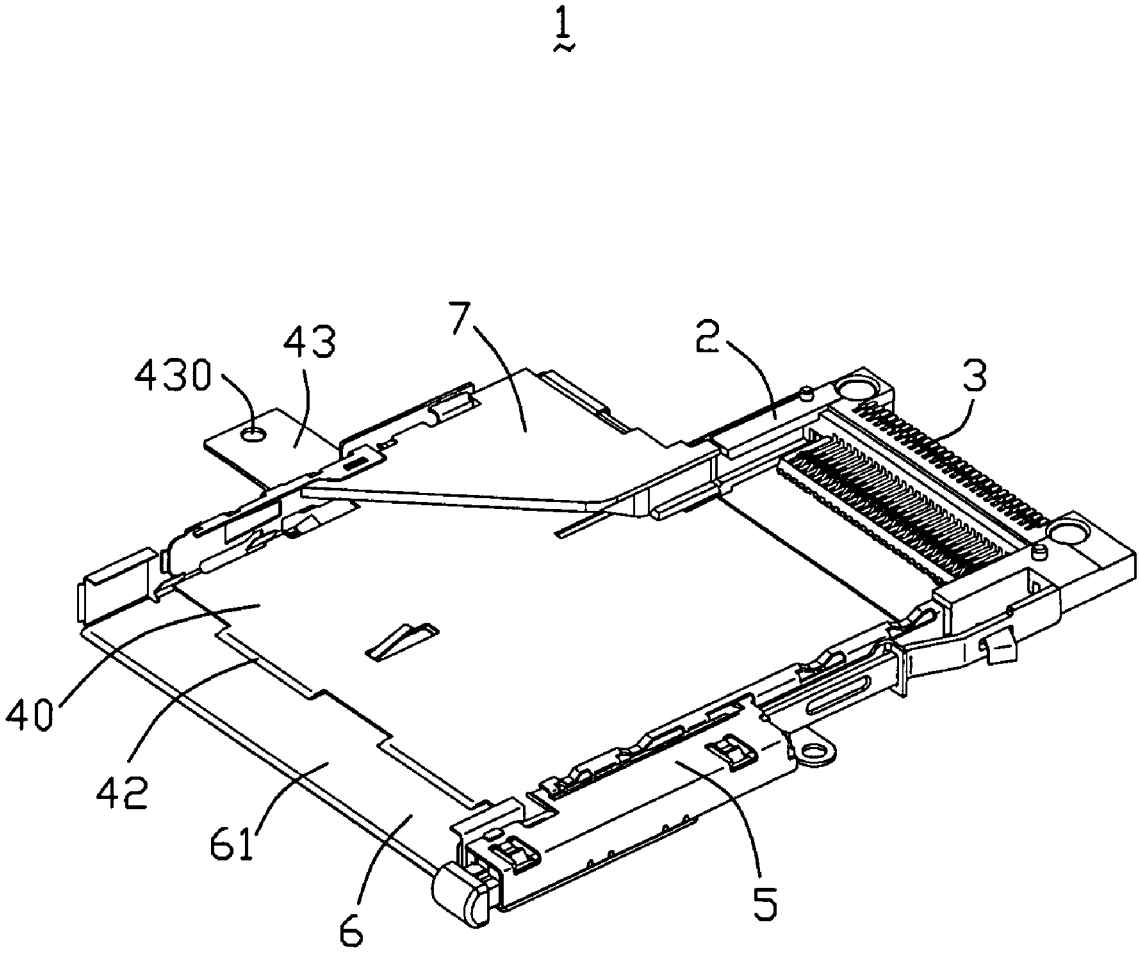
FIG. 2 is a view similar to FIG. 1, but taken from a different aspect.

Referring to FIGS. 1-5, the invention is embodied in an electrical card connector with an approximately L-shape configuration, generally referenced 1, for receiving two cards mentioned above, a rectangular electrical card, or an L-shaped electrical card that are according to Express Card specification. The electrical card connector 1, defining a card insertion/ejection direction, comprises an insulating housing 2, a plurality of terminals 3 received in the insulating housing 2, a shell 4 covering the insulating housing 2 and an ejector 5 installed at a side of the shell 4. A covering plate 6 spans across a rear end of the shell 4 and a guiding piece 7 is received in the shell 4.

The insulating housing 2 extending along a transverse direction perpendicular to the card insertion/ejection direction, comprises a body portion 20 and a pair of arms 21 extending backwardly from two ends of the body portion 20. A mating portion 22 also extends backwardly from the body portion 20 and is located between the pair of arms 21 and forms a flat gradient together with the body portion 20. A plurality of terminal receiving passageways 23 recess in the mating portion 22 together with the body portion 20 and receive the aligned terminals 3. The terminals 3 and the mating portion 22 altogether extend into a card receiving room (not labeled) formed by the shell 4 and mate with the inserted electrical card (not shown) electrically.

Figure 3:
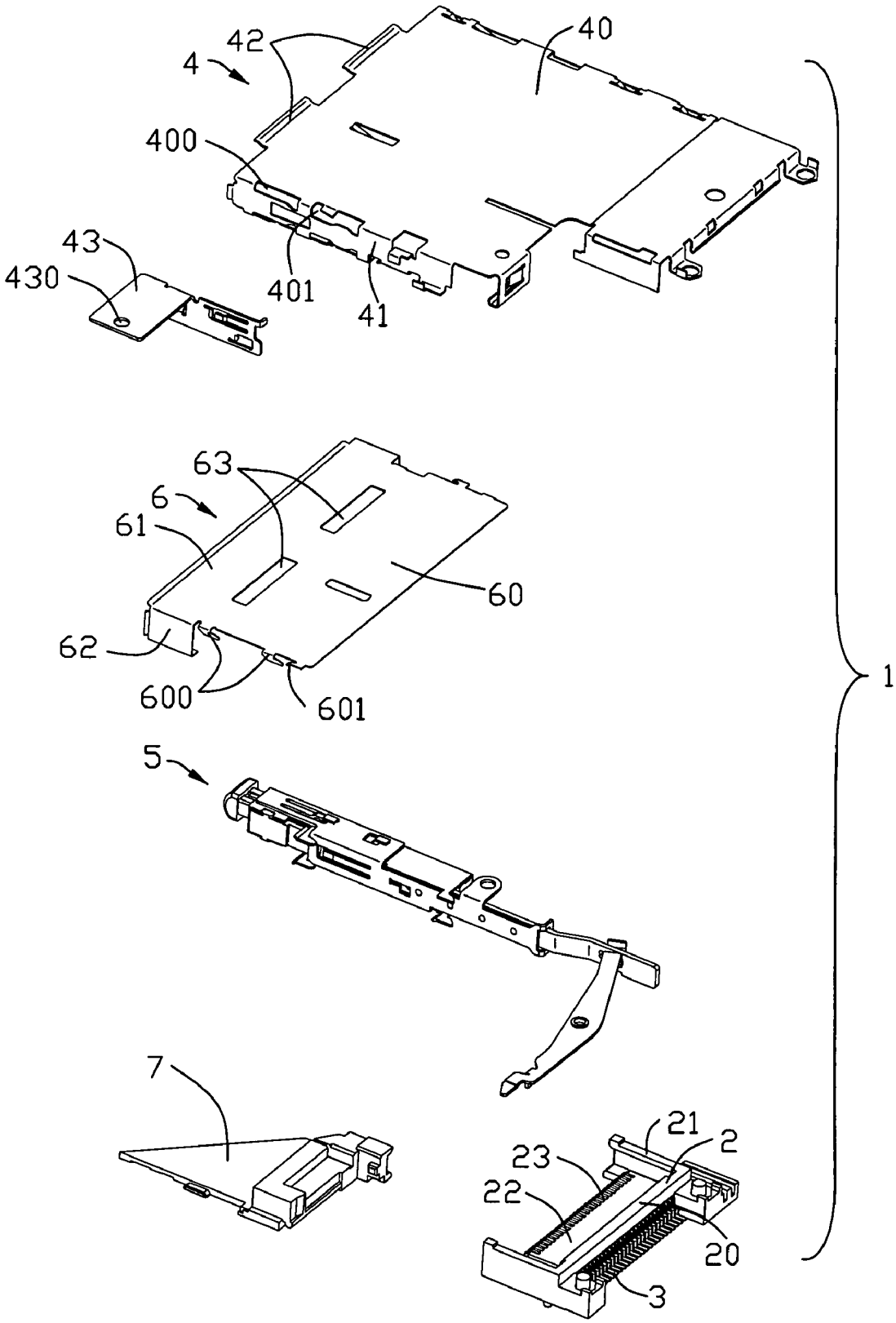
FIG. 3 is a perspective, exploded view of the electrical card connector.
Figure 4:
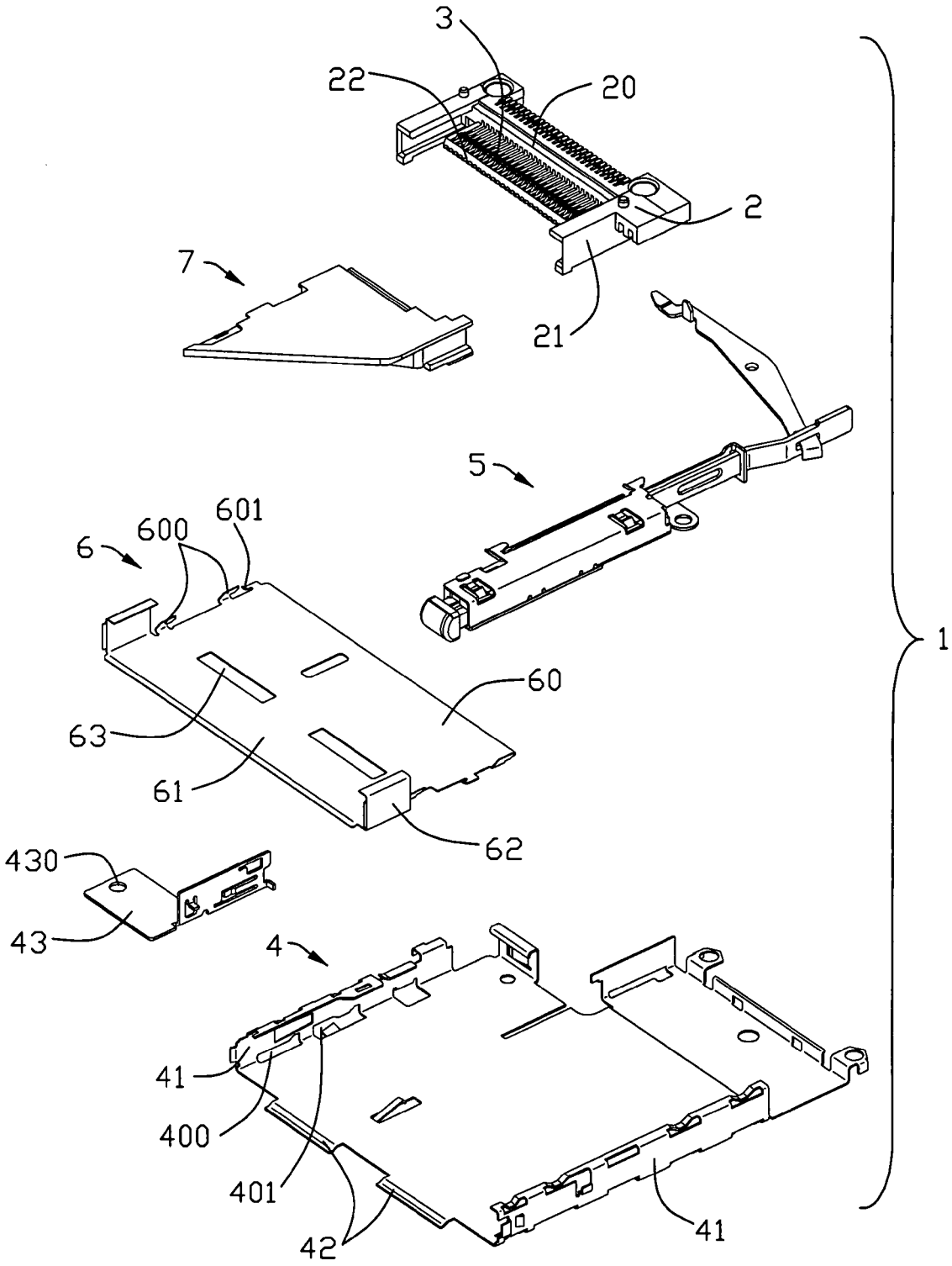
FIG. 4 is a view similar to FIG. 3, but taken from a different aspect.
Figure 5:
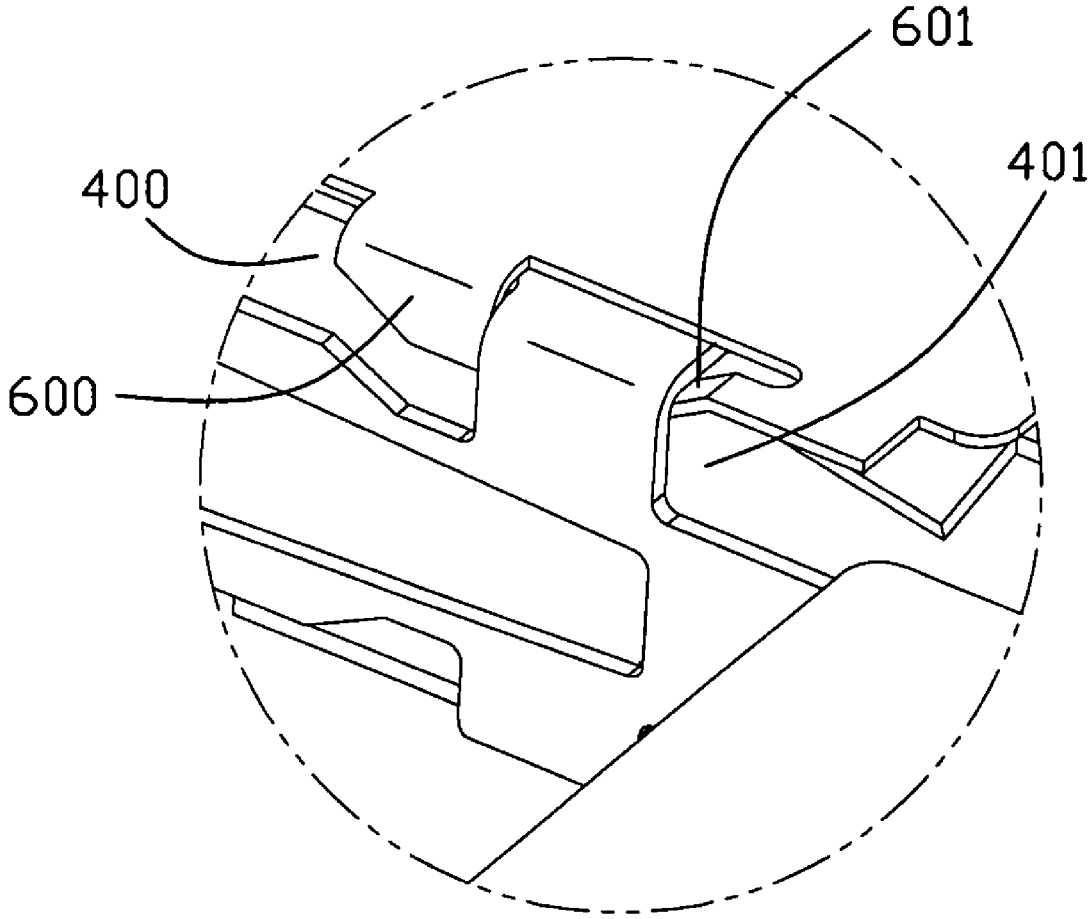
FIG. 5 is an amplified view of a circled portion in FIG. 1.

Referring to FIGS. 3-4, the shell 4 forms an approximately L-shape configuration with a rear end wider than a front end, thereby the card-receiving room is generally L-shaped in a horizontal plane. Of course, the term "horizontal" is not meant to be limited but is descriptive according to the drawings. The shell 4 comprises a top wall 40, and a pair of lateral walls 41 of different lengths downwardly extending from the top wall 40. A card inserting opening (not labeled) is defined at the rear end of the shell 4 between lateral walls 41 thereof, through which the electrical card is inserted into the card-receiving room along the card insertion direction. Each lateral wall 41 comprises a pair of slots 400, 401 locking with the covering plate 6. Furthermore, two locking portions 42 extend from the back margin of the top wall 40 backwardly and upwardly so as to cooperate with the covering plate 6. A fixing portion 43 with a fixing hole 430 is assembled on one of the lateral walls 41, so that the electrical card connector 1 is assembled onto a printed circuited board (not shown).

The covering plate 6, approximately of rectangular configuration, is preformed and has a front flat piece 60 shielding over the rear end of the shell 4 and a rear flat piece 61 extending from the front piece 60 as if stretching the shell 4. The rear flat piece 61 has a pair of guiding walls 62 extending downwardly from opposite sides thereof. Both the guiding walls 62 and the lateral walls 41 keep in a plane so as to guide the inserted electrical card. Each side of the front flat piece 60 forms a pair of forward stretching locking bars 600 and a backward stretching locking bar 601. The forward stretching locking bars 600 cooperate with a rear end of the lateral wall 41 through the card inserting opening and the slot 400 proximal to the card inserting opening, while the backward stretching locking bar 601 cooperates with the slot 401 distal from the card inserting opening, so that the covering plate 6 is fastened onto the shell 4. At the jointing section of the front flat piece 60 and the rear flat piece 61 is formed a pair of lengthwise grooves 63 to let the locking portions 42 penetrate into so as to further join the covering plate 6 and the shell 4.

When the electrical card connector 1 is assembled and mounted onto a printed circuit board (not shown) of an electrical device (not shown), the rear margin of the rear flat piece 61 is so situated behind a wall of the electrical device that an inserted card is prevented from cocking during inserting.

While a preferred embodiment in accordance with the present invention has been shown and described, equivalent modifications and changes known to persons skilled in the art according to the spirit of the present invention are considered within the scope of the present invention as described in the appended claims.

I claim:

1. An electrical card connector, defining a card insertion/ejection direction, comprising:

an insulating housing with a plurality of terminals received therein;

a shell having a pair of lateral walls and covering the insulating housing to form a card receiving room with a card inserting opening at a rear end thereof along a card insertion direction; and a covering plate mounted to and spanning over the rear end of the shell.

2. The electrical card connector as described in claim 1, wherein the covering plate comprises a front flat piece shielding over the rear end of the shell and a rear flat piece extending rearward from the front flat piece.

3. The electrical card connector as described in claim 2, wherein a pair of guiding walls extend from opposite ends of the rear flat piece and align with the pair of lateral walls of the shell to guide the inserted card.

4. The electrical card connector as described in claim 3, wherein the covering plate locks with the shell by at least one forward stretching locking bar and at least one backward stretching locking bar formed at each side of the front flat piece.

5. The electrical card connector as described in claim 4, wherein each lateral wall of the shell has one slot to receive the backward stretching locking bar to provide a backward locking force, while the forward stretching locking bar is received in another slot of the same lateral wall of the shell.

6. The electrical card connector as described in claim 3, wherein the covering plate comprises at least one groove and the shell comprises at least one locking portion received in the at least one groove.

7. The electrical card connector as described in claim 1, further comprising a guiding piece received in the shell to guide the card's insertion.

8. The electrical card connector as described in claim 1, further comprising an ejector assembled at one side of the shell.

9. An electrical card connector assembly defining a card insertion/ejection axis, comprising:

an insulating housing having a plurality of terminals received therein;

a metallic shell located upon the housing and cooperating with the insulating housing to define a card receiving room with a card inserting opening at a rear end thereof along a card insertion/ejection axis under a condition that said shell is dimensioned with a standard size corresponding to an industry standard; and a metallic covering plate assembled to the shell and extending over the rear end of the shell with a distance along said card insertion/ejection axis so as to form a combined structure including the shell and the covering plate, said combined structure defining a lengthened dimension along said card insertion/ejection axis compared with said standard size.

10. The assembly as claimed in claim 9, wherein a metallic fixing portion is assembled to the shell to enhance fastening between the covering plate and the shell, and said fixing portion further includes a mounting tab laterally extending beyond a transverse dimension of the shell.

11. The assembly as claimed in claim 10, wherein said mounting tab is essentially coplanar with the shell.

12. An electrical card connector assembly defining a card insertion/ejection axis, comprising:

an insulating housing having a plurality of terminals received therein;

a metallic shell located upon the housing and cooperating with the insulating housing to define a card receiving room with a card inserting opening at a rear end thereof along a card insertion/ejection axis under a condition that said shell is dimensioned with a standard size corresponding to an industry standard; and a metallic fixing portion assembled to the shell to enhance fastening between a covering plate and the shell, and said fixing portion further including a mounting tab laterally extending beyond a transverse dimension of the shell; wherein said mounting tab is essentially coplanar with the shell.

* * * * *